US008142968B2

(12) United States Patent
Altavela et al.

(10) Patent No.: US 8,142,968 B2
(45) Date of Patent: Mar. 27, 2012

(54) PHOTORECEPTOR WITH RELEASE LAYER

(75) Inventors: Robert P. Altavela, Webster, NY (US); Yuhua Tong, Webster, NY (US); Edward F. Grabowski, Webster, NY (US); Kent J. Evans, Lima, NY (US); Adilson Ramos, Webster, NY (US); Nancy Belknap, Rochester, NY (US); Helen R. Cherniack, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 402 days.

(21) Appl. No.: 12/486,668

(22) Filed: Jun. 17, 2009

(65) Prior Publication Data

US 2010/0323288 A1 Dec. 23, 2010

(51) Int. Cl.
*G03G 5/00* (2006.01)

(52) U.S. Cl. ..... 430/60; 430/127; 430/131

(58) Field of Classification Search ..... 430/60, 430/127, 131

See application file for complete search history.

(56) References Cited

U.S. PATENT DOCUMENTS

| | | | | |
|---|---|---|---|---|
| 4,291,773 | A | 9/1981 | Evans | |
| 4,464,450 | A | 8/1984 | Teuscher | |
| 4,518,669 | A | 5/1985 | Yashiki | |
| 4,579,801 | A | 4/1986 | Yashiki | |
| 4,775,605 | A | 10/1988 | Seki et al. | |
| 5,017,449 | A | 5/1991 | Yoshihara | |
| 5,344,734 | A | 9/1994 | Monbaliu et al. | |
| 5,385,796 | A | 1/1995 | Spiewak et al. | |
| 5,449,573 | A | 9/1995 | Aoki et al. | |
| 5,489,496 | A | 2/1996 | Katayama et al. | |
| 5,641,599 | A | 6/1997 | Markovics et al. | |
| 5,656,407 | A | 8/1997 | Kawahara | |
| 5,721,080 | A | 2/1998 | Terrell et al. | |
| 5,922,498 | A | 7/1999 | Yuh et al. | |
| 5,928,824 | A | 7/1999 | Obinata et al. | |
| 6,136,485 | A | 10/2000 | Ishida et al. | |
| 6,180,309 | B1 | 1/2001 | Maty et al. | |
| 6,183,921 | B1 * | 2/2001 | Yu et al. | 430/58.7 |
| 6,200,716 | B1 | 3/2001 | Fuller et al. | |
| 6,207,334 | B1 | 3/2001 | Dinh et al. | |
| 2005/0175910 | A1 | 8/2005 | Yanus et al. | |

FOREIGN PATENT DOCUMENTS

| | | |
|---|---|---|
| JP | 63144359 | 6/1988 |
| JP | 2003122031 | 4/2003 |
| JP | 2004045497 | 2/2004 |

OTHER PUBLICATIONS

European Search Report dated Sep. 22, 2010, EP application serial No. 10165801.1, 3 pages.

* cited by examiner

*Primary Examiner* — Mark A Chapman
(74) *Attorney, Agent, or Firm* — Pillsbury Winthrop Shaw Pittman LLP

(57) ABSTRACT

The disclosed embodiments are directed to an electrophotographic photoreceptor having a release layer. More particularly, the disclosure relates to an electrophotographic photoreceptor having a release layer which comprises an organosilane compound coated over the substrate surface. Other embodiments include methods for coating layer removal using a specifically configured electrophotographic photoreceptor having a release layer and methods for recovering a charge transport molecule.

23 Claims, 2 Drawing Sheets

PHOTORECEPTOR WITH RELEASE LAYER

CROSS REFERENCE TO RELATED APPLICATIONS

Reference is made to co-pending, U.S. patent application to Altavela et al., filed the same day as the present application, entitled, "Process for the Removal of Photoreceptor Coatings using a Stripping Solution" Ser. No. 12/486591, the entire disclosures of which are incorporated herein by reference in its entirety.

BACKGROUND

The disclosure relates to electrophotographic photoreceptor designs, particularly electrophotographic photoreceptors having a release layer, which provides a means to improve the coating removal process. More particularly, the disclosure relates to photoreceptors having a release layer which comprises an organosilane compound coated over the substrate surface.

Further provided herein are methods for coating layer removal using a specifically configured electrophotographic photoreceptor having a release layer. According to one aspect of the disclosed invention, there is provided methods for recycling or remanufacturing electrophotographic photoreceptors.

Yet, further provided herein are methods for recovering a charge transport molecule, more particularly, during the coating removal process.

In electrophotography, the substrate for photoreceptors is required to be manufactured with high dimensional accuracy in terms of straightness and roundness, optimum surface reflectance and roughness, and desired thickness. In order to obtain such a dimensional accuracy, the substrate surface is cut at a high accuracy by using a diamond tool and/or the like. Once the substrate surface is formed, at least one coating of photosensitive material is applied to the substrate, which may comprise an undercoat layer and an imaging layer. During the manufacturing process, the quality of the dip coated photoreceptor layers, coated by any suitable conventional technique, such as, spraying, dip coating, draw bar coating, gravure coating, silk screening, air knife coating, reverse roll coating, vacuum deposition, chemical treatment, and the like, may vary due to the complexity of the process nature. Defective devices are rejected and may be remanufactured.

Remanufacturing electrophotographic photoreceptors can be quite difficult and costly. For example, coating removal and recoating of the photosensitive material requires the prior removal of the end flanges of the photoreceptor with excessive force and torque that usually causes the substrate to deform, and the complete adhesive residue removal is critical for maintaining the overall straightness, roundness and concentricity of the final remanufactured assembly.

Thus, there exists a need to reduce the cost of remanufacturing electrophotographic photoreceptors, for example, by removing the photosensitive or coating layers without damaging the substrate formation. This not only reduces the cost of producing the photoreceptor, but also decreases the cost for disposing the rejected substrate materials.

Conventional photoreceptors and their materials are disclosed in Katayama et al., U.S. Pat. No. 5,489,496; Yashiki, U.S. Pat. No. 4,579,801; Yashiki, U.S. Pat. No. 4,518,669; Seki et al., U.S. Pat. No. 4,775,605; Kawahara, U.S. Pat. No. 5,656,407; Markovics et al., U.S. Pat. No. 5,641,599; Monbaliu et al., U.S. Pat. No. 5,344,734; Terrell et al., U.S. Pat. No. 5,721,080; and Yoshihara, U.S. Pat. No. 5,017,449, which are herein all incorporated by reference.

More recent photoreceptors are disclosed in Fuller et al., U.S. Pat. No. 6,200,716; Maty et al., U.S. Pat. No. 6,180,309; and Dinh et al., U.S. Pat. No. 6,207,334, which are all herein incorporated by reference.

Conventional undercoat or charge blocking layers are also disclosed in U.S. Pat. No. 4,464,450; U.S. Pat. No. 5,449,573; U.S. Pat. No. 5,385,796; and Obinata et al, U.S. Pat. No. 5,928,824, which are all herein incorporated by reference.

SUMMARY

According to aspects illustrated herein, there is provided an electrophotographic photoreceptor, including a substrate; a release layer coated over the substrate; and a plurality of coating layers disposed over the release layer, wherein the release layer is soluble in a release solvent including alcohol, water, or mixtures thereof, and further wherein the release layer provides for separability of the release layer and plurality of coating layers from the substrate during manufacture or recycling of the electrophotographic photoreceptor. In one embodiment, an electrophotographic photoreceptor, further including a flange that is disposed at an end portion of the photoreceptor.

In embodiments, the thickness of the substrate is from about 0.5 mm to about 3 mm. A substrate may be made from aluminum or an aluminum alloy. In one embodiment, a plurality of coating layers includes an undercoat layer, a charge generation layer, a charge transport layer, and a single imaging layer comprising a combination of a charge generation layer and charge transport layer. The thickness of the undercoat layer may be from about 20 nm to about 30 microns. The thickness of the charge generation layer is from about 10 nm to about 5 microns. The thickness of the charge transport layer may be from about 0.5 micron to about 50 microns.

In embodiments, a release layer includes an organosilane compound. An organosilane compound may be present in an amount of from about 0.1 percent to about 100 percent by weight of the total weight of the release layer. An organosilane compound includes gamma-aminopropyltriethoxysilane, gamma-glycidoxypropyltrimethoxysilane, N-beta-aminoethyl gamma-aminopropyltrimethoxysilane, gamma-glycidoxypropyl trimethoxysilane, gamma-glycidoxypropyl methyidimethoxysilane, gamma-glycidoxypropyl dimethylmethoxysilane, gamma-glycidoxypropyl triethoxysilane, gamma-glycidoxypropyl methyldiethoxysilane, gamma-glycidoxypropyl dimethylethoxysilane, beta-3,4-epoxycyclohexyl)ethyltrimethoxysilane, beta-(3,4-epoxycyclohexyl) ethylmethyidimethoxysilane, beta-(3,4-epoxycyclohexyl) ethyldimethylmethoxysilane, beta-(3,4-epoxycyclohexyl) ethyltriethoxysilane, beta-(3,4-epoxycyclohexyl) ethylmethyidiethoxysilane, beta-(3,4-epoxycyclohexyl) ethyldimethylethoxysilane, 4-aminobutyltriethoxysilane, hydroxymethyltriethoxysilane, 3-[hydroxy(polyethyleneoxy)propyl]heptamethyltrisiloxane, 2-(carboymethylthio)ethyltrimethylsilane, or mixtures thereof. In one embodiment, an organosilane compound is gamma-aminopropyltriethoxysilane.

Embodiments herein also provide methods of separating a plurality of coating layers from an electrophotographic photoreceptor including a substrate disposed over a counter bore; a release layer coated over the substrate and the counter bore; and a plurality of coating layers disposed over the release layer, the method including the steps of subjecting the electrophotographic photoreceptor to a release solvent; dissolving the release layer in the release solvent; separating the plurality of coating layers from the substrate and the counter bore. In one embodiment, a subjecting step includes soaking the electrophotographic photoreceptor in a release solvent. In another embodiment, an electrophotographic photoreceptor is soaked in the release solvent for a period of between about 1 minutes and about 10 days. In one embodiment, the temperature of the release solvent is at room temperature. In another embodiment, the temperature of the release solvent is elevated to about 50° C. to less than 100° C. In one embodiment, a substrate is made from aluminum or an aluminum alloy. In certain embodiments, a plurality of coating layers comprises an undercoat layer, a charge generation layer and a charge transport layer. In one embodiment, an organosilane compound is present in an amount of from about 0.1 percent to about 100 percent by weight of the total weight of the release layer. In one embodiment, an organosilane compound is gamma-aminopropyltriethoxysilane.

Embodiments herein also provide methods of recovering a charge transport molecule including subjecting an electrophotographic photoreceptor to a release solvent, the electrophotographic photoreceptor including a substrate, a release layer coated over the substrate, and a plurality of coating layers disposed over the release layer, wherein the release layer provides for separability of the release layer and plurality of coating layers from the substrate during manufacture or recycling of the electrophotographic photoreceptor; dissolving the plurality of coating layers in the release solvent, wherein at least one of the plurality of coating layers comprises a charge transport molecule; extracting the charge transport molecule; and purifying the charge transport molecule. In one embodiment, a charge transport molecule is N,N'-diphenyl-N,N'bis(3-methylphenyl)-1,1'-biphenyl)-4,4'diamine.

BRIEF DESCRIPTION OF THE DRAWINGS

For a better understanding, reference may be had to the accompanying figure.

Unless otherwise noted, the same reference numeral in different Figures refers to the same or similar feature.

DETAILED DESCRIPTION

Figure 1:
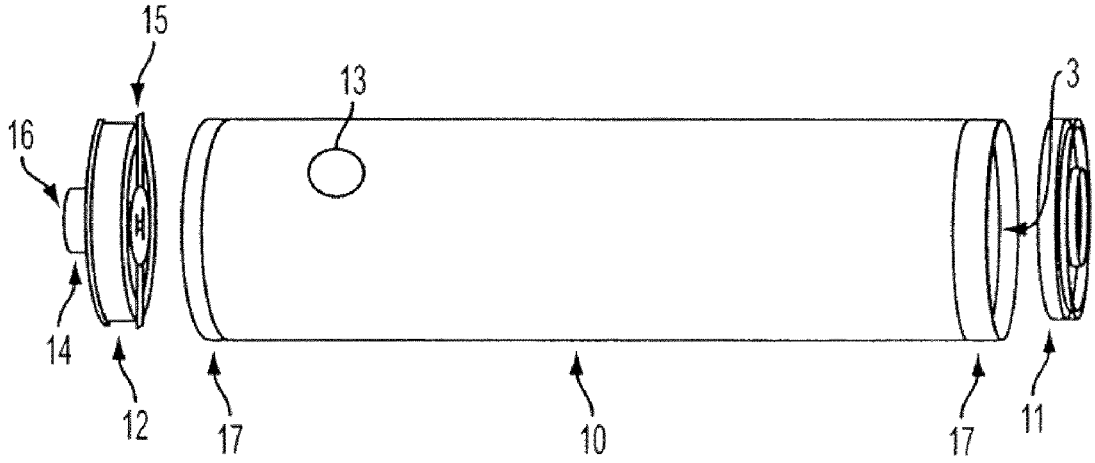
FIG. 1 is an illustration of an electrophotographic photoreceptor in accordance with the present embodiments.

In the following description, reference is made to the accompanying drawings, which form a part hereof and which illustrate several embodiments. It is understood that other embodiments may be utilized and structural and operational changes may be made without departure from the scope of the present disclosure. The same reference numerals are used to identify the same structure in different figures unless specified otherwise. The structures in the figures are not drawn according to their relative proportions and the drawings should not be interpreted as limiting the disclosure in size, relative size, or location.

FIG. 1 is an illustration of an electrophotographic photoreceptor showing the construction of the photoreceptor drum and various key layers. As shown in FIG. 1, the electrophotographic photoreceptor includes a cylindrical photoreceptor drum 10, a release layer 3, and flanges 11 and 12 fitted to the opening at each end of the photoreceptor drum 10. Outboard flange 11 and Inboard flange 12 are mounted at the ends of the cylindrical counter bore 17 using an epoxy adhesive. Inboard flange 12 consists of a bearing 14, ground strap 15 and drive gear 16. In some designs, either flange could containing the ground strap, the drive gear and the bearing or the function can be split between the two flanges in any combination that has a spring contact to the bearing shaft and a friction contact to the inner substrate surface. The other members 13 constituting the electrophotographic photoreceptor are described below. The member layers 13 are shown in FIG. 2.

Figure 2:
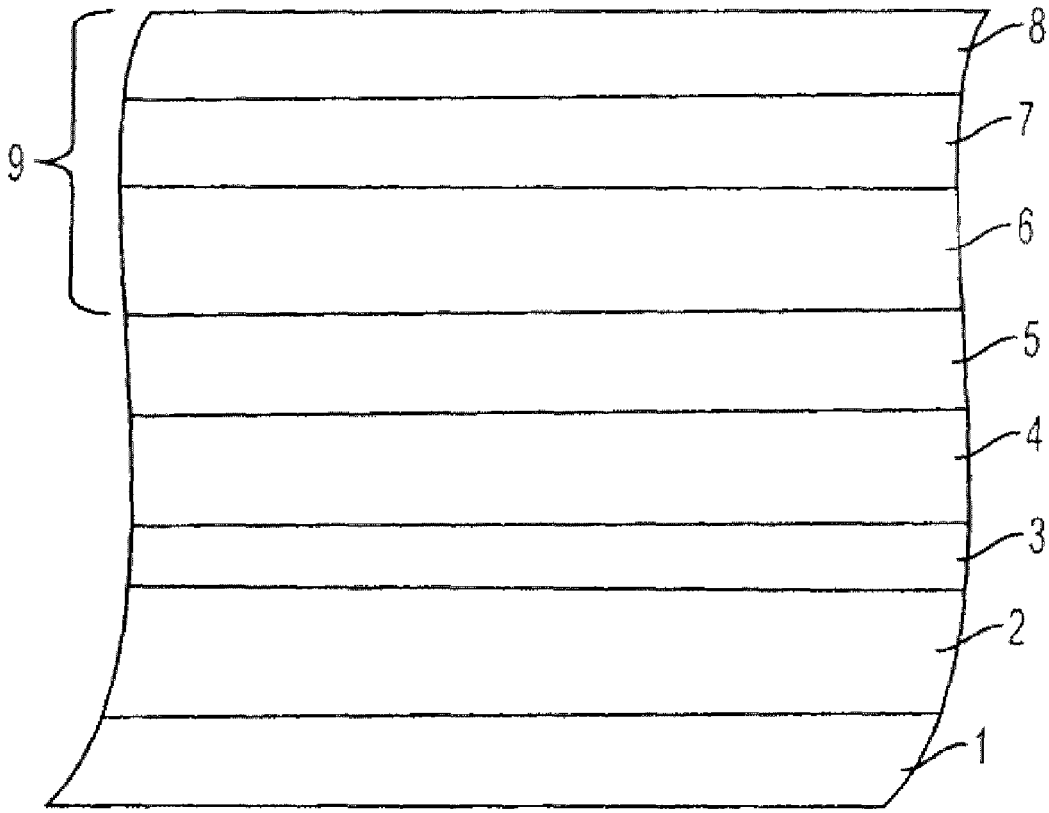
FIG. 2 illustrates an electrophotographic photoreceptor showing various layers in accordance with the present embodiments.

FIG. 2 illustrates a typical electrophotographic photoreceptor showing various layers. Multilayered electrophotographic photoreceptors or imaging members can have at least two layers, and may include a substrate, a conductive layer, a release layer, an undercoat layer, an optional adhesive layer, a photogenerating layer, a charge transport layer, an optional overcoat layer and, in some embodiments, an anticurl backing layer. In the multilayer configuration, the active layers of the photoreceptor are the charge generation layer (CGL) and the charge transport layer (CTL). Enhancement of charge transport across these layers provides better photoreceptor performance. Overcoat layers are commonly included to increase mechanical wear and scratch resistance.

The undercoating layer is generally located between the substrate and the imaging layer, although additional layers may be present and located between these layers. The imaging member may also include a charge generating layer and a charge transport layer.

Typically, a flexible or rigid substrate 1 is provided with an optional electrically conductive surface or coating 2. The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, filled with an electrically conducting substance, such as carbon, metallic powder, and the like, or an organic electrically conducting material. In certain embodiments, the substrate is made from aluminum or an aluminum alloy.

The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or, of a minimum thickness of less than a millimeter. Similarly, a flexible belt may be of substantial thickness, for example, about 250 micrometers, or of minimum thickness less than 50 micrometers, provided there are no adverse effects on the final electrophotographic device. The wall thickness of the substrate is manufactured to be at least about 0.5 mm to fulfill the physical requirements of the photoreceptor device. In certain embodiments, the thickness of the substrate is from about 0.5 mm to about 3 mm, or from about 0.9 mm to about 2.0 mm. However, the thickness of the substrate can also be outside of these ranges.

The surface of the substrate is polished to a mirror-like finish by a suitable process such as diamond turning, metallurgical polishing, glass bead honing and the like, or a combination of diamond turning followed by metallurgical polishing or glass bean honing. Minimizing the reflectivity of the surface may eliminate a defect causes by surface reflections that has the appearance of a plywood patterns in half tone areas of prints. In certain embodiments, the surface roughness of an ahoned substrate is between about 0.14 to about 0.26 microns.

In embodiments, where the substrate layer is not conductive, the surface thereof may be rendered electrically conductive by an electrically conductive coating 2. The conductive coating may vary in thickness over substantially wide ranges depending upon the optical transparency, degree of flexibility desired, and economic factors.

A release layer 3 may be deposited onto a substrate 1, or onto an electrically conductive coating 2, if present. A release layer may also be applied to a counter bore 17 of the photoreceptor. An undercoat layer 4 may be formed on a release layer 3. In certain embodiments, part or all of the optional adhesive layer 5 may be in contact with the release layer. A release layer includes one or more organosilane compounds (hydrolyzed silane compounds). Organosilane compounds include, for example, gamma-aminopropyltriethoxysilane, gamma-glycidoxypropyltrimethoxysilane, N-beta-aminoethyl gamma-aminopropyltrimethoxysilane, gamma-glycidoxypropyl trimethoxysilane, gamma-glycidoxypropyl methyidimethoxysilane, gamma-glycidoxypropyl dimethylmethoxysilane, gamma-glycidoxypropyl triethoxysilane, gamma-glycidoxypropyl methyldiethoxysilane, gamma-glycidoxypropyl dimethylethoxysilane, beta-(3,4-epoxycyclohexyl)ethyltrimethoxysilane, beta-(3,4-epoxycyclohexyl) ethylmethyldimethoxysilane, beta-(3,4-epoxycyclohexyl) ethyldimethylmethoxysilane, beta-(3,4-epoxycyclohexyl) ethyltriethoxysilane, beta-(3,4-epoxycyclohexyl) ethylmethyldiethoxysilane, beta-(3,4-epoxycyclohexyl) ethyidimethylethoxysilane, 4-aminobutyltriethoxysilane, hydroxymethyltriethoxysilane, 3-[hydroxy(polyethyleneoxy)propyl]heptamethyltrisiloxane, and 2-(carboymethylthio)ethyltrimethylsilane. In certain embodiments, an organosilane compound is present in an amount of from about 0.1 percent to about 100 percent by weight of the total weight of a release layer. A release layer may also optionally contain other ingredients such as, for example, poly(ethylene oxide), poly(acrylic acid), and acetic acid. In one embodiment, a release layer is gamma-aminopropyltriethoxysilane. The thickness of the release layer is between about 50 nm and about 10 microns, between about 0.1 micron and about 5 microns, or between about 0.5 micron and about 2 microns. A release layer includes materials that have good adhesion to the layers that are in contact with the release layer, such layers include the substrate, the counter bore, the undercoat layer, and the adhesive layer. A release layer also demonstrates good solubility in a release solvent. Examples of release solvents include, but are not limited to, water, tetrahydrofuran, methyl ethyl ketone, acetone, toluene, methylene chloride, chlorobenzene, ammonium hydroxide solution, dimethylformamide, N-methylpyrrolidinone, and alcohol, such as, methanol, ethanol, propanol, and mixtures thereof. In certain embodiments, the release layer is water soluble. In certain embodiments, the release layer has desirable electrical properties, good adhesion to the metallized substrate, such as the aluminum substrate, and provides good adhesion to the undercoat layer.

A release layer 3 may be applied or coated onto a substrate and/or a counter bore by any suitable technique known in the art, such as spraying, dip coating, draw bar coating, gravure coating, silk screening, air knife coating, reverse roll coating, vacuum deposition, chemical treatment and the like. Additional vacuuming, heating, drying and the like, may be used to remove any solvent remaining after the application or coating to form the release layer.

In certain embodiments, an entire substrate is coated with a release layer comprising one or more organosilane compounds. In certain embodiments, an entire substrate is coated with a release layer comprising gamma aminopropyltriethoxy silane.

An undercoat layer 4 may be applied to a release layer 3. The thickness of the undercoat layer is from about 20 nm to about 30 microns. In one embodiment, the thickness of the undercoat layer is from about 1 to about 23 microns.

An imaging member may be provided in a number of forms. For example, the imaging member may be a homogeneous layer of a single material or it may be a composite layer containing a photoconductor and another material. In addition, the imaging member may be layered. These layers can be in any order, and sometimes can be combined in a single or mixed layer.

At least one imaging layer 9 is formed on an adhesive layer 5 or an undercoat layer 4. An imaging layer 9 may be a single layer that performs both charge-generating and charge transport functions as is well known in the art, or it may comprise multiple layers such as a charge generator layer 6, a charge transport layer 7, and an optional overcoat layer 8. Generally, the thickness of the charge generation layer is from about 10 nm to about 5 microns. In one embodiment, the thickness of the charge generation layer is from about 10 nm to about 1 micron.

The thickness of the charge transport layer 7 is from about 0.5 microns to about 50 microns. In one embodiment, the thickness of the charge transport layer is from about 15 to about 35 microns.

The charge-transport layer 7 may comprise a charge transport molecule dissolved or molecularly dispersed in a film forming electrically inert polymer such as a polycarbonate. The term "dissolved" as employed herein is defined herein as forming a solution in which the charge transport molecule is dissolved in the polymer to form a homogeneous phase. The expression "molecularly dispersed" is used herein is defined as a charge transport molecule dispersed in the polymer, the molecules being dispersed in the polymer on a molecular scale. Any suitable charge transporting or electrically active molecule may be employed in the charge transport layer of this invention. The expression charge transport molecule is defined herein as a monomer that allows the free charge photogenerated in the transport layer to be transported across the transport layer. Typical charge transport molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine (m-TBD), hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis(4-N,N'-diethylaminophenyl)-1,2,4-oxadiazole, stilbenes and the like. In certain embodiments, the charge transport molecule is N,N'-diphenyl-N,N'-bis(3-methylphenyl)-(1,1'-biphenyl)-4,4'-diamine. Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference.

The embodiments further provide a method for removing a plurality of coating layers from an electrophotographic photoreceptor comprising a release layer as described herein. The release layer facilitates the removal of the photosensitive layer while preserving the electrical performance characteristics. The layer must provide adequate charge transport between the conductive layer and the undercoat layer or generation layer. The method comprises subjecting an electrophotographic photoreceptor to a release solvent, dissolving a release layer in the release solvent, and separating a plurality of coating layers from the electrophotographic photoreceptor. In general, the entire photoreceptor layers are separated from the substrate. In order to separate each coating layers, a control dissolving process may need to be applied. In certain embodiments, the method comprises soaking an electrophotographic photoreceptor to a release solvent, dissolving a release layer in the release solvent, and separating a plurality of coating layers from the electrophotographic photoreceptor. In certain embodiments, the method comprises soaking an electrophotographic photoreceptor in water, dissolving a release layer in water, and separating the plurality of coating layers from the electrophotographic photoreceptor. The process temperature is strongly related to the boiling point of the solvents, but in general, it should be less than 100° C. The temperature of the release solvent may be kept at room temperature, or it may be elevated to improve the dissolution of the release layer. For example, the temperature of the release solvent is elevated to between about 50° C. to less than 100° C., or between 60° C. to about 90° C. In general, the dissolution process includes soaking an electrophotographic photoreceptor in a release solvent for a period of between about 1 minute and up to several days, depending on the efficiency of the solvents and temperatures. For example, an electrophotographic photoreceptor may be soaked in a release solvent for a period of between about 1 minute and about 10 days, for a period of between about 5 minutes and about 5 days, or for a period of between about 1 hour and about 10 hours. Typically, the entire release layer is dissolved in the release solvent. However, part or the entire release layer may also be swollen in the release solvent to be separated from the substrate.

Yet, the embodiments further provide a method for recovering a charge transport molecule. The method comprises subjecting an electrophotographic photoreceptor to a release solvent, the electrophotographic photoreceptor comprising a substrate, a release layer coated over the substrate, and a plurality of coating layers disposed over the release layer, wherein the release layer provides for separability of the release layer and plurality of coating layers from the substrate during manufacture or recycling of the electrophotographic photoreceptor, and further wherein at least one of the plurality of coating layers comprises a charge transport molecule; dissolving the charge transport molecule in the release solvent; extracting the charge transport molecule; and purifying the charge transport molecule.

The plurality of coating layers may not be soluble in the release solvent. In certain embodiments, the method further comprises separating the plurality of coating layers by filtration. In certain embodiments, the method further comprises drying the filtrate containing the charge transport molecule. In certain embodiments, the method further comprises extracting the charge transport molecule. In certain embodiments, the method further comprises purifying the charge transport molecule. In certain embodiments, the charge transport molecule is N,N'-diphenyl-N,N'bis(3-methylphenyl)-(1,1'-biphenyl)-4,4'diamine.

The terms "charge blocking layer", "hole blocking layer" and "blocking layer" are generally used interchangeably with the phrase "undercoat layer."

The terms "charge generation layer," "charge generating layer," and "charge generator layer") are generally used interchangeably with the phrase "photogenerating layer."

The terms "charge transport molecule" are generally used interchangeably with the terms "hole transport molecule."

The term "electrostatographic" includes "electrophotographic" and "xerographic."

The term "photoreceptor" or "photoconductor" is generally used interchangeably with the terms "imaging member."

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

A polyester resin V2200B (purchased from Bostik), 10 g, polycarbonate PCZ-200, 10 g, and 3-aminopropyltriethoxysilane, 20 g, were mixed in solvents containing ethanol, 1 g, tetrahydrofuran, 252 g, and toluene, 108 g. After mixing for 2 hours at room temperature, the clear solution was coated onto an aluminum photoreceptor substrate and dried at 125° C. for 15 minutes. This release layer was coated at a thickness between about 0.5 micron and about 2 microns. Then, photoreceptor layers including charge generation layer and charge transport layer (25 microns) were coated to form a finished photoreceptor device.

The xerographic electrical properties of the device can be determined by known means, including as indicated herein electrostatically charging the surfaces thereof with a corona discharge source until the surface potentials, as measured by a capacitively coupled probe attached to an electrometer, attained an initial value $V_o$ of about −700 volts. Each member was then exposed to light from a 780 nanometer laser with >100 erg/cm$^2$ exposure energy, thereby inducing a photodischarge which resulted in a reduction of surface potential to a Vlow value measured at 2.65 ergs/cm$^2$, a Vr value (residual potential). Table 1 summarizes the electrical performance of these devices as compared to a control sample without release layer, and which table data illustrates the electron transport from the device to the conductive ground plane is maintained by the release layer in the illustrative photoconductive members of the present invention.

TABLE 1

| Sample (Release layer thickness) | V (0) | 2.65 ergs | Vr |
|---|---|---|---|
| 2.0 um | 705 | 288 | 68 |
| 0.5 um | 704 | 288 | 62 |
| Control-0 um | 704 | 286 | 60 |

The above described photoreceptor device was submersed in a mixture of ethanol, tetrahydrofuran and water (ratio 25/25/50 by weight) at 60° C.±2° C. for 1 hour. All photoreceptor layers were fallen off the aluminum substrate by slightly shaking.

All the patents and applications referred to herein are hereby specifically, and totally incorporated herein by reference in their entirety in the instant specification.

It will be appreciated that various of the above-disclosed and other features and functions, or alternatives thereof, may be desirably combined into many other different applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An electrophotographic photoreceptor, comprising:

a substrate;

a release layer coated over the substrate;

an undercoat layer disposed over the release layer; and a plurality of coating layers disposed over the undercoat layer, wherein the release layer is soluble in a release solvent comprising alcohol, water, or mixtures thereof, and further wherein the release solvent provides for separability of the release layer and plurality of coating layers from the substrate during manufacture or recycling of the electrophotographic photoreceptor.

2. The electrophotographic photoreceptor of claim 1, further comprising a flange that is disposed at an end portion of the photoreceptor.

3. The electrophotographic photoreceptor of claim 1, wherein the thickness of the substrate is from about 0.5 to about 3 mm.

4. The electrophotographic photoreceptor of claim 1, wherein the substrate is made from aluminum or an aluminum alloy.

5. The electrophotographic photoreceptor of claim 1, wherein the plurality of coating layers comprises one or more of the following layers: a charge generation layer, a charge transport layer, and a single imaging layer comprising a combination of a charge generation layer and charge transport layer.

6. The electrophotographic photoreceptor of claim 5, wherein the thickness of the undercoat layer is from about 20 nm to about 30 microns.

7. The electrophotographic photoreceptor of claim 5, wherein the thickness of the charge generation layer is from about 10 nm to about 5 microns.

8. The electrophotographic photoreceptor of claim 5, wherein the thickness of the charge transport layer is from about 0.5 microns to about 50 microns.

9. The electrophotographic photoreceptor of claim 1, wherein the release layer comprises an organosilane compound.

10. The electrophotographic photoreceptor of claim 9, wherein the organosilane compound is present in an amount of from about 0.1 percent to about 100 percent by weight of the total weight of the release layer.

11. The electrophotographic photoreceptor of claim 9, wherein the organosilane compound is selected from the group consisting of:

gamma-aminopropyltriethoxysilane, gamma-glycidoxypropyltrimethoxysilane, N-beta-aminoethyl gamma-aminopropyltrimethoxysilane, gamma-glycidoxypropyl trimethoxysilane, gamma-glycidoxypropyl methyldimethoxysilane, gamma-glycidoxypropyl dimethylmethoxysilane, gamma-glycidoxypropyl triethoxysilane, gamma-glycidoxypropyl methyldiethoxysilane, gamma-glycidoxypropyl dimethylethoxysilane, beta-(3,4-epoxycyclohexyl)ethyltrimethoxysi lane, beta-(3,4-epoxycyclohexyl)ethylmethyldimethoxysilane, beta-(3,4-epoxycyclohexyl)ethyldimethylmethoxysilane, beta-(3,4-epoxycyclohexyl)ethyltriethoxysilane, beta-(3,4-epoxycyclohexyl) ethylmethyldiethoxysilane, beta-(3,4-epoxycyclohexyl)ethyldimethylethoxysilane, 4-aminobutyltriethoxysilane, hydroxymethyltriethoxysilane, 3-[hydroxy(polyethyleneoxy)propyl]heptamethyltrisiloxane, 2-(carboymethylthio)ethyltrimethylsilane, and mixtures thereof.

12. The electrophotographic photoreceptor of claim 11, wherein the organosilane compound is gamma-aminopropyltriethoxysilane.

13. A method of separating a plurality of coating layers from an electrophotographic photoreceptor comprising a substrate disposed over a counter bore; a release layer coated over the substrate and the counter bore; an undercoat layer disposed over the release layer; and a plurality of coating layers disposed over the release layer, the method comprising the steps of:

subjecting the electrophotographic photoreceptor to a release solvent;

dissolving the release layer in the release solvent; and separating the plurality of coating layers from the substrate and the counter bore.

14. The method of claim 13, wherein the subjecting step comprises soaking the electrophotographic photoreceptor in a release solvent.

15. The method of claim 13, wherein the electrophotographic photoreceptor is soaked in the release solvent for a period of between about 1 minute and about 10 days.

16. The method of claim 13, wherein the temperature of the release solvent is at room temperature.

17. The method of claim 13, wherein the temperature of the release solvent is elevated to about 50° C. to less than 100° C.

18. The method of claim 13, wherein the substrate is made from aluminum or an aluminum alloy.

19. The method of claim 13, wherein the plurality of coating layers comprises a charge generation layer and a charge transport layer.

20. The method of claim 13, wherein the organosilane compound is present in an amount of from about 0.1 percent to about 100 percent by weight of the total weight of the release layer.

21. The method of claim 13, wherein the organosilane compound is gamma-aminopropyltriethoxysilane.

22. A method of recovering a charge transport molecule comprising:

subjecting an electrophotographic photoreceptor to a release solvent, the electrophotographic photoreceptor comprising a substrate, a release layer coated over the substrate, an undercoat layer disposed over the release layer, and a plurality of coating layers disposed over the undercoat layer, wherein the release layer provides for separability of the release layer and plurality of coating layers from the substrate during manufacture or recycling of the electrophotographic photoreceptor;

dissolving the plurality of coating layers in the release solvent, wherein at least one of the plurality of coating layers comprises a charge transport molecule;

extracting the charge transport molecule; and purifying the charge transport molecule.

23. The method of claim 22, wherein the charge transport molecule is N,N'-diphenyl-N,N'bis(3-methylphenyl)-(1,1'-biphenyl)- 4,4'diamine.

* * * * *